US010697744B1

(12) United States Patent
Kinzer

(10) Patent No.: US 10,697,744 B1
(45) Date of Patent: Jun. 30, 2020

(54) PIVOTING BROADHEAD BLADE ASSEMBLY

(71) Applicant: Kye Kinzer, Las Cruces, NM (US)

(72) Inventor: Kye Kinzer, Las Cruces, NM (US)

( * ) Notice: Subject to any disclaimer, the term of this patent is extended or adjusted under 35 U.S.C. 154(b) by 0 days.

(21) Appl. No.: 16/449,809

(22) Filed: Jun. 24, 2019

(51) Int. Cl.
*F42B 6/08* (2006.01)

(52) U.S. Cl.
CPC ..... *F42B 6/08* (2013.01)

(58) Field of Classification Search
CPC ..... F42B 6/08
See application file for complete search history.

(56) References Cited

U.S. PATENT DOCUMENTS 2,993,697 A 7/1961 Urban
4,973,060 A * 11/1990 Herzing ..... F42B 6/08 473/583
5,472,213 A 12/1995 Dudley
6,935,976 B1 * 8/2005 Grace, Jr. ..... F42B 6/08 473/583
8,105,187 B1 1/2012 Sanford
8,287,407 B1 * 10/2012 Sanford ..... F42B 6/08 473/583
2015/0072812 A1 3/2015 Sanford
2015/0105192 A1 4/2015 Powell
2016/0273892 A1 * 9/2016 Pedersen ..... F42B 6/08
2019/0376772 A1 * 12/2019 Romero ..... F42B 6/08

FOREIGN PATENT DOCUMENTS

DE 3116175 A2 11/1962

* cited by examiner

*Primary Examiner* — John A Ricci
(74) *Attorney, Agent, or Firm* — Law Office of Jeff Williams PLLC; J. Oliver Williams

(57) ABSTRACT

A broadhead assembly including a main body, a pivoting blade, a trailing arm, and a collar, so as to permit the selection of multiple cutting diameters. The blade is coupled to the main body proximate to the tip. The blade is configured to pivot about an axis in communication with the main body to operate between a first position and a second position. The blade includes a socket along a trailing edge. A trailing arm extends between the main body and the blade and has a disc for insertion into the socket. The collar selectively regulates rotation of the trailing arm and therefor the pivoting of the blades so as to vary the cutting diameter. The collar is configured to include channels of different depths and slopes and restricts rotation of the trailing arm by particular alignment of the trailing arm with a particular set of channels.

20 Claims, 7 Drawing Sheets

PIVOTING BROADHEAD BLADE ASSEMBLY

BACKGROUND

1. Field of the Invention

The present application relates to archery equipment, and more particularly to broadhead hunting tips for arrows having a plurality of pivoting blades.

2. Description of Related Art

Present tips used in arrow hunting typically include a single rigid member having one or more cutting edges. The cutting edges are sharpened to cut into an animal or other target upon impact. The head or tip of the rigid member may be relatively narrow or may be broadened away from the shaft of the arrow to increase the size of the impact zone on the target. An example may include ferrule heads or tips. In such an instance, each tip is one singular rigid member.

More recently, various designs have been made to increase the size of the tip to cause more damage. The concept of an increase in size is designed to occur at impact, therefore the pre-impact form of the tip is compact while the post-impact form is expanded. This expanded form is useful to ensure a quick kill of the animal thereby not requiring a second shot. These tips are designed with blades that are tucked or at least partially hidden internally within the tip. They are traditionally stored with the tip forward of the pivot point, such that pressure axially applied on the tip upon impact causes the blades to pivot outward about an axis.

Some disadvantages remain with conventional pivoting blade designs. Some blade designs rely upon a stacking of the blades along the shaft wherein the blades are layered upon one another. This takes up space internally and can make the design more complex. Additionally, when blades are sized such that the blades need to be layered on one another, the blades and broadhead are typically large and either become slower to deploy or necessitate too much energy transfer at impact that the speed of the arrow slows. These disadvantages are seen with blades that have a large sweeping area. Although in principle, this design appears adequate, the large sweeping motion of the rotating blades results in increased deployment time and slower relative blade tip speeds immediately after impact. A slower relative speed can lead to decrease cutting effectiveness of the pivoting blades.

Another disadvantage of conventional pivoting blades is the manner in which the blades are stored and connected. The blade typically uses a singular pin-like connection with the main body of the broadhead which may or may not be concealed within the main body. A secondary trailing arm folds out with the main blade, and extends between the trailing edge of the blade and a trailing point on the main body. The trailing arm acts to serve as a support to keep the blade in the swept outward position. However, such trailing arms are typically hinged with the pin-like connection along the trailing edge of the blade as well. This connection results in the layering of the blade and the trailing arm. This type of connection creates drag upon penetration and decreases cutting effectiveness.

Likewise, another disadvantage stems from the inability of a single broadhead to adapt to different swept configurations. Typically, the pivoting blades are designed to sweep outward to a particular angle and distance. This results in the pivoting blades having only a single cutting diameter. There exist moments when the cutting diameter either needs to be changed or becomes desirable to be change. With conventional broadheads, that generally necessitates the changing out of the entire broadhead. Therefore, a user must maintain multiple broadheads and take the time to interchange them as needed.

Although strides have been made to provide improved broadheads with pivoting blades, considerable shortcomings remain. It is desired that an improved broadhead be provided that includes pivoting blades that are designed to maximize cutting effectiveness by not layering the blades and maintaining smooth joints with trailing arms. Additionally, it is desired that the broadhead provide the ability to adjust the cutting diameter as needed.

SUMMARY OF THE INVENTION

It is an object of the present application to provide a broadhead with pivoting blades having a main body with a central axis aligned with the shaft axis. The main body including a mating surface to couple to the arrow shaft. A pivoting blade is pivotally coupled to the main body proximate to the tip. The pivoting blade is configured to pivot about a pivot axis in communication with the main body so as to operate between a first position and a second position. The pivoting blade includes a socket along a trailing edge. A trailing arm extends between the main body and the pivoting blade and has a disc for insertion into the socket.

The broadhead is configured to locate the pivoting blades outward and away from the central axis, such that the pivoting blades fail to contact or pass through the central axis. The pivoting blades have a plane of rotation that is parallel to the central axis and are configured to sweep between the first position and the second position without contacting or passing through the central axis. This all ensures that the pivoting blades are not layered with one another as each avoids crossing the central axis as they move in their plane of rotation.

A further object of the present application is to have the disk on the trailing arm be mounted within the socket of the blade. The height or thickness of the disk matches that of the blade such that the disc remains parallel with the surfaces of the blade. This allows the connection of the blade and trailing arm to refrain from drag and decreased cutting effectiveness.

Another object of the present application is to permit for the ability to regulate the cutting diameter of the pivoting blades between shots of the broadhead. The broadhead of the present application includes a collar positioned between the shaft and the base of the broadhead. The collar includes a plurality of channels that selectively align with the trailing arm of the pivoting blades. Channels may include different depths and slopes. As the pivoting blade rotates, the trailing arm contacts a selected channel aligned therewith. Contact within the channel can restrict movement of the pivoting blades.

Likewise, it is an object that the collar be repositionable to allow a user to choose which channels align with the trailing arms. Some channels are designed to permit no rotation, partial rotation, or full rotation of the pivoting blades. A user may loosen the shaft to permit selective rotation of the collar to switch alignment of the trailing arm with a secondary channel.

It is an object of the present application that the collar be interchangeable for use on different broadheads.

Another object is that the method of use of the collar be simplified. The method includes obtaining the collar and then locating the collar at the base of the broadhead with the top surface adjacent to the broadhead. The collar is then aligned with at least one of the plurality of channels with at least one of the pivoting blades. Then the collar is secured by compressing the collar between the base of the broadhead and a shaft. The shaft can be loosed to permit free rotation of the collar and then the shaft retightened.

Ultimately the invention may take many embodiments and is not limited to the particular embodiments shown herein. The broadhead assembly of the present application overcomes the disadvantages inherent in the prior art.

The more important features of the assembly have thus been outlined in order that the more detailed description that follows may be better understood and to ensure that the present contribution to the art is appreciated. Additional features of the assembly will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the assembly in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present assembly.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
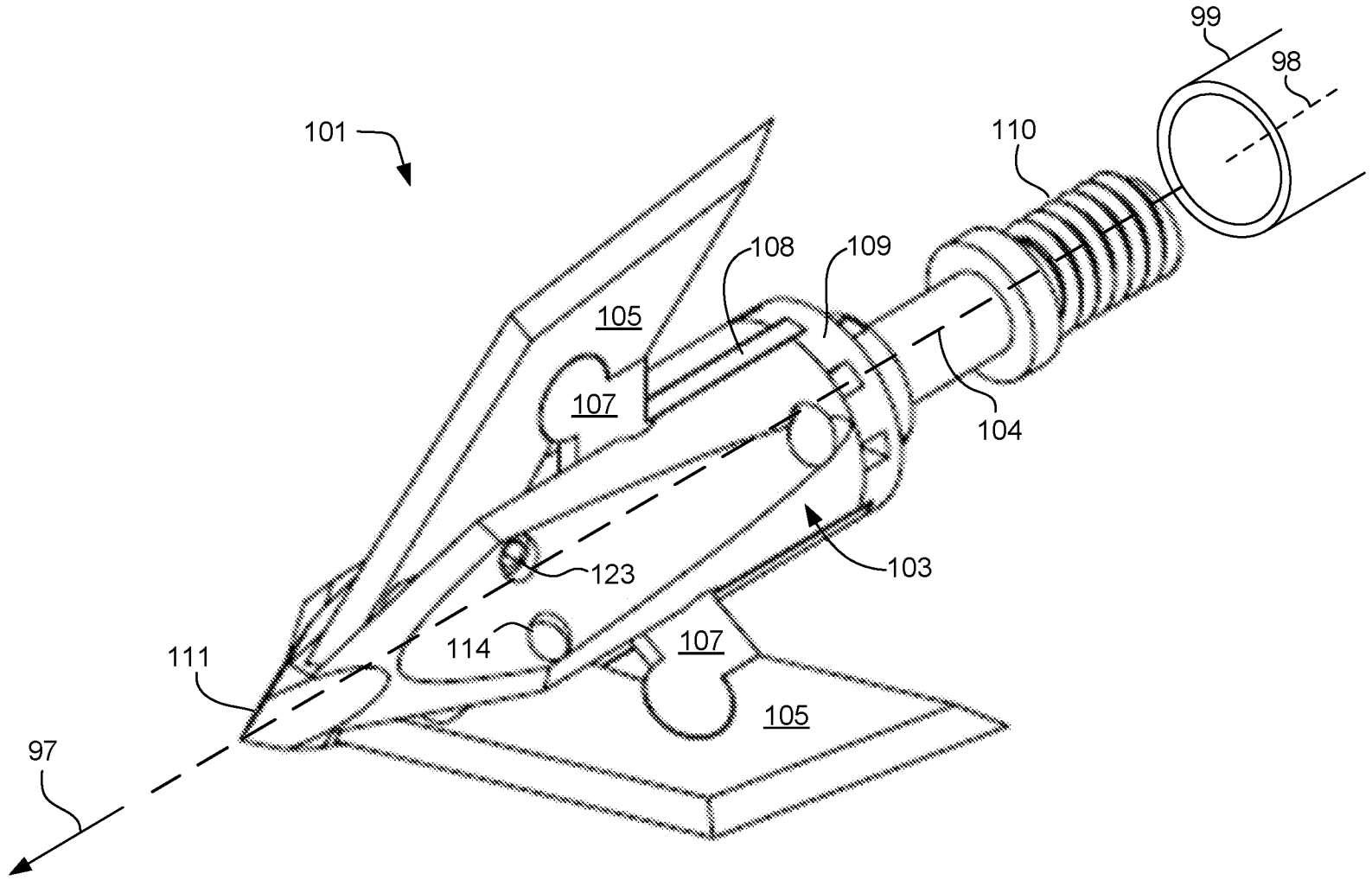
FIG. 1 is a front perspective view of a broadhead assembly with pivoting blades according to an embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly and method in accordance with the present application overcomes one or more of the above-discussed problems commonly associated with existing broadheads with rotating blades. In particular, the assembly of the present application is configured to include pivoting blades that operate to maximize cutting effectiveness by not layering the pivoting blades and maintaining smooth joints with trailing arms. Additionally, the broadhead assembly provides the ability to adjust the cutting diameter as needed through selective manipulation of a collar. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a main body with a central axis aligned with a shaft axis of the arrow. The main body including a mating surface to couple to the arrow shaft. A pivoting blade is pivotally coupled to the main body proximate to the tip. The pivoting blade is configured to pivot about a pivot axis in communication with the main body so as to operate between a first position and a second position. The pivoting blade includes a socket along a trailing edge. A trailing arm extends between the main body and the pivoting blade and has a disc for insertion into the socket. A collar is included to selectively regulate rotation of the trailing arm and therefor the pivoting of the blades. The collar is configured to include channels of different depths and slopes and restricts rotation of the trailing arm by particular alignment of the trailing arm with a particular channel. Additional features and functions of the device are illustrated and discussed below.

Referring now to the Figures wherein like reference characters identify corresponding or similar elements in form and function throughout the several views. The following Figures describe the assembly of the present application and its associated features. With reference now to the Figures, an embodiment of the present invention and method of use is herein described. It should be noted that the articles "a", "an", and "the", as used in this specification, include plural referents unless the content clearly dictates otherwise.

Figure 2:
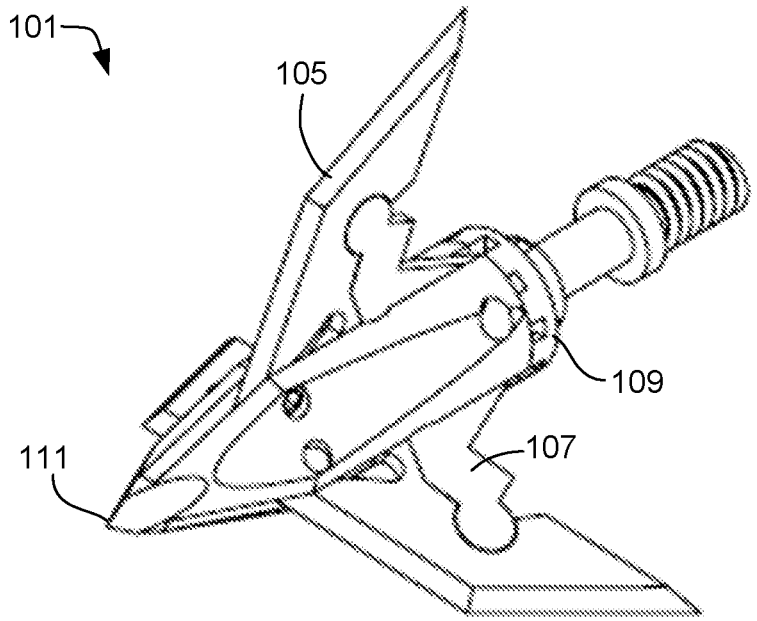
FIG. 2 is an alternate front perspective view of the broadhead assembly of FIG. 1, with pivoting blades extended.
Figure 3:
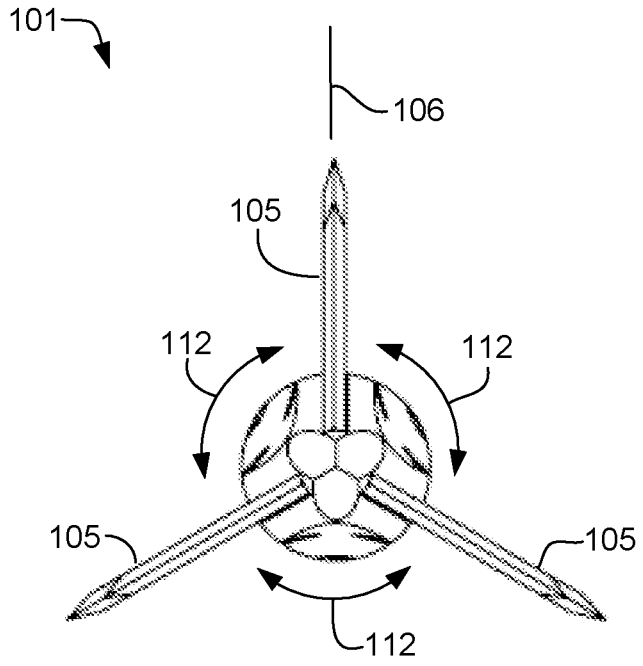
FIG. 3 is a front view of the broadhead assembly of FIG. 1.

Referring now to FIGS. 1-3 in the drawings, a broadhead assembly 101 with pivoting blades 105 is illustrated. Assembly 101 is configured to couple to an arrow, having arrow shaft 99, and be propelled through the air in a forward trajectory 97. Assembly 101 includes a main body 103, pivoting blades 105, trailing arms 107, and a collar 109. Main body 103 defines a central axis 104 which is concentric with shaft axis 98.

Main body 103 extends from a tip 111 to a threaded base 110. Base 110 is configured to pass within shaft 99 and mate with a corresponding internal thread therein. Shaft 99 couples to threaded base 110 via interference fit. When fully seated, shaft 99 extends upward over and around assembly 101 until it contacts a bottom surface of collar 109. The diameter of collar 109 and shaft 99 are ideally similar.

Main body 103 also includes a plurality of longitudinal slots 108 that extend from tip 111 to collar 109. Blades 105 and trailing arms 107 are configured to pivot or rotate within slots 108, thereby operating between a first position wherein trailing arm 107 is at least partially concealed within slot 108 (see FIG. 1) and a second position wherein trailing arm 107 is pivoted outward with blade 105 (see FIG. 2). Blades 105 pivot within a plane of rotation 106 that is parallel to central axis 104. The amount of rotation of blades 105 dictates the cutting diameter of assembly 101.

Body 103 also includes an aperture 114 for housing a pin 123 which defines the point of rotation of blade 105. Pin 123 defines an axis upon which blades 105 pivot about. Aperture 114 is adjacent tip 111. The distal end of blades 105 sweep outward away from central axis 104 upon impact. As blades 105 pivot outward, trailing arms 107 likewise pivot outward. Trailing arms 107 are also coupled to main body 103 at a point adjacent collar 109 (see FIG. 10).

As seen in FIG. 3, blades 105 are equally spaced about central axis 104. Assembly 101 contains a plurality of blades 105 and are not limited to the number depicted or described. It is understood that two or more blades may be used. The angle 112 between blades 105 is equalized in accordance with the number of blades to help ensure suitable flight characteristics of assembly 101.

Each of the blades 105 have an edge adjacent central axis 104. The form and shape of blades 105 are such that movement from the first position to the second position either maintains blade 105 a set distance away from the central axis 104 or moves blade 105 further away, such that blade 105 fails to contact or pass through the central axis 104. This all ensures that the pivoting blades are not layered with one another as each avoids crossing the central axis as they move in their plane of rotation. By avoiding layering of blades 105, body 105 may be maintained in a more compact design.

Figure 4:
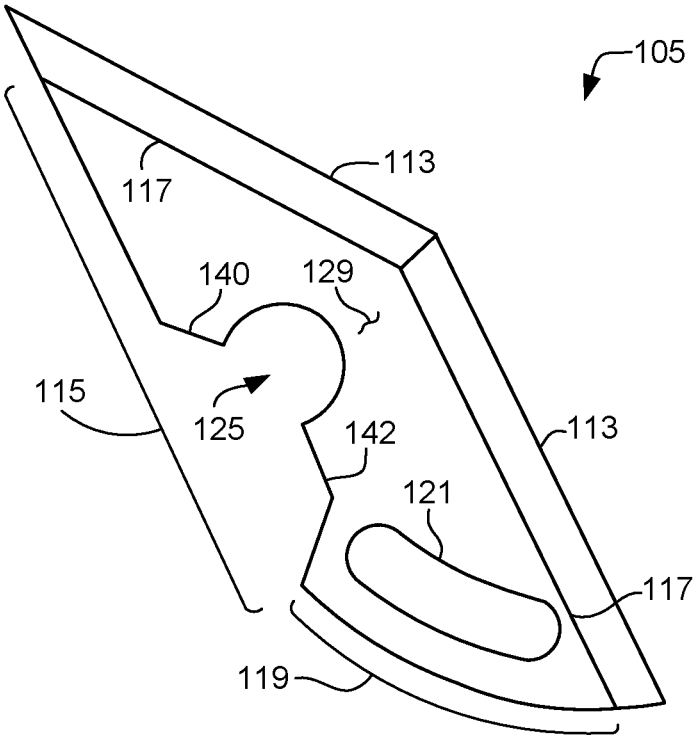
FIG. 4 is a side view of a blade in the broadhead assembly of FIG. 1.
Figure 5:
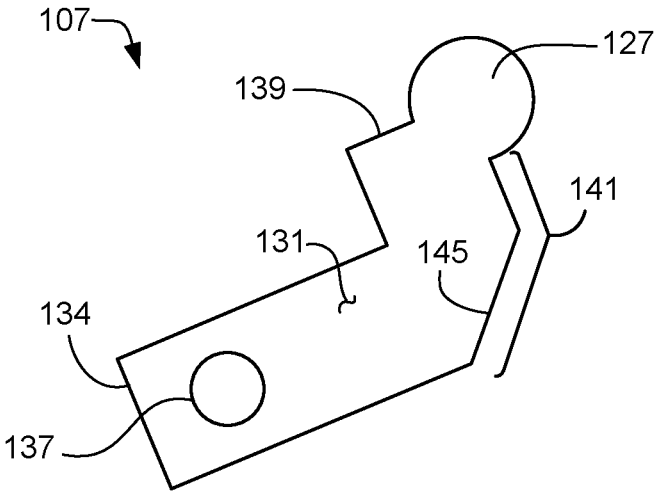
FIG. 5 is a side view of a trailing arm in the broadhead assembly of FIG. 1.

Referring now also to FIGS. 4 and 5 in the drawings, side views of blade 105 and trailing arm 107 are illustrated. Blade 105 has a leading edge 113 and a trailing edge 115. Leading edge 113 is a cutting edge of blade 105, wherein edge 113 is a relatively singular edge, such that it ends in a singular point. Edge 113 is formed from a transition line 117 as the thickness of blade 105 tapers down to the singular edge. Trailing edge 115 extends along the rear and inner edge of blade 105 bound between curved edge 119 and leading edge 113. It is understood that curved edge 119 may be linear, as opposed to curved, in some embodiments. It is also worth noting that some portions of leading edge 113 may in fact not be tapered to a singular point as stated above. Areas of leading edge 113 may be blunted compared to the singular edge. For example, leading edge 113 adjacent tip 111 may be blunted to help flight characteristics.

Blade 105 includes a slot 117 that passes there through. Slot 121 is offset from curved edge 119 by a set distance. Additionally, the curvature of slot 121 may match that of curved edge 119. In select embodiments the curvature of slot 121 may be different than that of edge 119. Pin 123 is configured to engage slot 121 such that movement of blade 105 between the first and second positions results in a translation of pin 123 through slot 121. The movement of pin 123 in slot 121 at the different positions is more clearly seen in FIGS. 6 and 7. It is understood that slot 121 and pin 123 are not limited to the embodiment herein described. Pin 123 may take the form of a tab that translates within a groove (as opposed to a slot).

Blade 105 further includes a socket 125 formed along trailing edge 115. Socket 125 is configured to be a curved cut-out through blade 105 wherein the curved surface area of socket 125 extends beyond 180 degrees but less than 360 degrees radially. Formed at a first end of trailing arm 107 is a disk 127 configured to snap into and fit within socket 125. As socket 125 extends beyond 180 degrees, disk 127 only slides into and out of socket 125 by moving perpendicular to upper surface 129. Disk 127 is configured to rotate within socket 125 between the first position and the second position. Perpendicular movement between them is restricted by main body 103 and slot 108.

Figure 8:
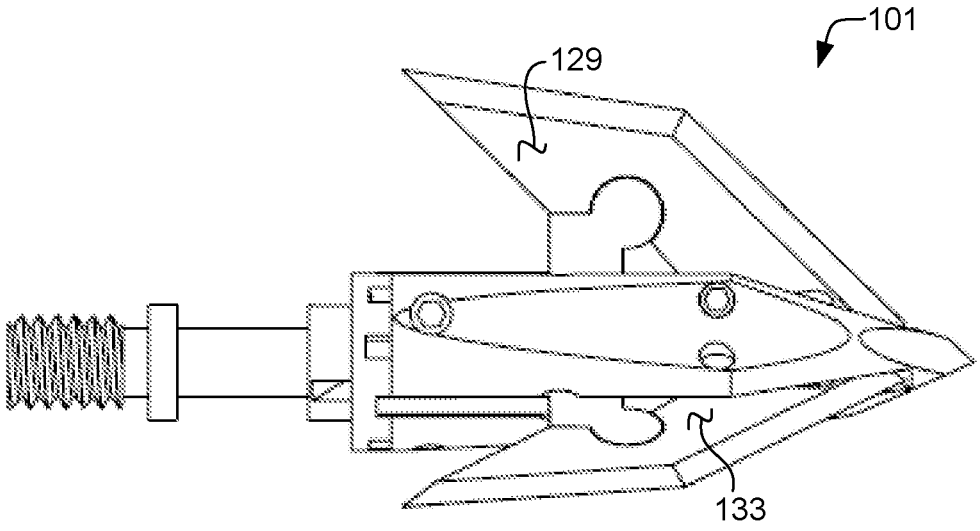
FIG. 8 is a side view of the broadhead assembly of FIG. 1 with the pivoting blades in a first position.
Figure 9:
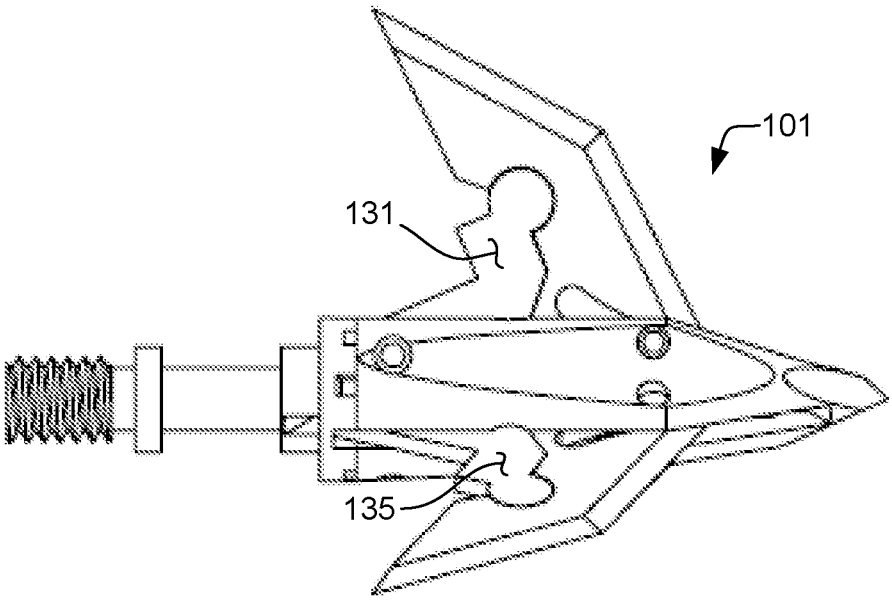
FIG. 9 is an alternate side view of the broadhead assembly of FIG. 8, with the pivoting blades in a second position.

Trailing arm 107 includes a body that is ideally equal in thickness to that of blade 105, apart from leading edge 113, such that the thickness of disk 127 may be less than or equal to that of blade 105. Therefore, an upper surface 131 of trailing arm 107 would be flush with upper surface 129 of blade 105. Corresponding lower surfaces 133 and 135 for each are seen in FIGS. 8 and 9. Other thicknesses are possible, even those where disk 127 is thicker than trailing arm 107.

Trailing arm 107 includes an aperture 137 configured to provide a pivot location for arm 107 as movement between the first and second positions occurs. Main body 103 passes into at least a portion of aperture 137. Aperture 137 is similar to that of slot 121 in that aperture 137 is not limited to the embodiment herein described. Main body 103 may utilize a tab or a pin 138 (see FIG. 10) to engage aperture 137. Aperture 137 may pass wholly through arm 107 or may be a groove with a bottom surface.

Figure 6:
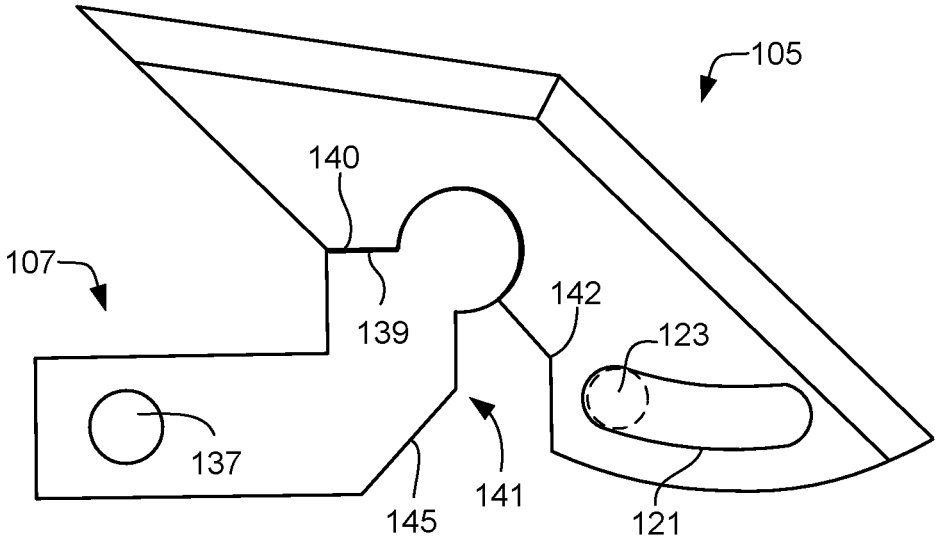
FIGS. 6 and 7 are combined side views of the blade of FIG. 4 and the trailing arm of FIG. 5 in representative first and second positions.
Figure 7:
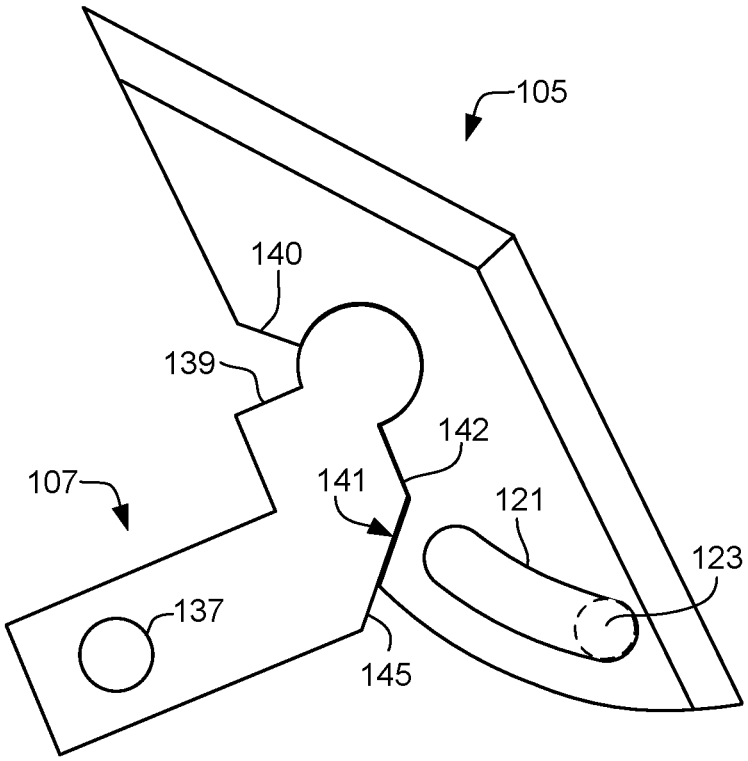

Referring now also to FIGS. 6 and 7 in the drawings, combined side views of blade 105 and trailing arm 107 are illustrated in representative first and second positions. As noted previously, movement between the first and second positions necessitates rotation of both blade 105 and arm 107. As both have a defined pivot location with main body 103 and a combined pivot location in socket 125 and disk 127, it is necessary that at least one pivot location permits a degree of freedom to slide or translate. This is done with slot 121. Set rotation points at socket 125 and aperture 137 induce translation of pin 123 in slot 121. It is understood that slot 121 is not required to be on blade 105. Other embodiments may locate the moveable rotation point on arm 107 or potentially at the combined socket location.

During movement between positions, different portions of trailing arm 107 contacts trailing edge 115 of blade 105. Trailing edge 115 includes internal edges either side of socket 125, namely edge 140 and edge 142. Trailing arm 107 has a first edge 139 and a second edge 141. In the first position, first edge 139 is configured to contact edge 140. In the second position, second edge 141 is configured to contact edge 142. The contacting of edges 139-142 act to create a stop or restriction to movement beyond a minimum and maximum point.

Referring now also to FIGS. 8 and 9 in the drawings, side views of assembly 101 are illustrated in the first and second positions. As seen in these figures, lower surfaces 133 and 135 of blade 105 and trailing arm 107, respectively, are shown. Prior to impact, blade 105 remains in the first position as seen in FIG. 8. Upon impact, blade 105 rotates into the second position, as shown in FIG. 9, wherein pin 123 translates toward leading edge 117 as seen in FIG. 7. When blade 105 is in the first position, as seen in FIG. 6, pin 123 is located adjacent trailing edge 115.

Also to note in FIGS. 8 and 9 are the locations of slots 108 relative to collar 109. Slots 108 are aligned with channels in collar 109 and that movement of trailing arm 107 into the second position has trailing arm 107 passing within the aligned slot 108. Other channels are depicted that are not aligned with slots 108. Each of the other channels are have a different depth as measured from a top surface of collar 109.

Figure 10:
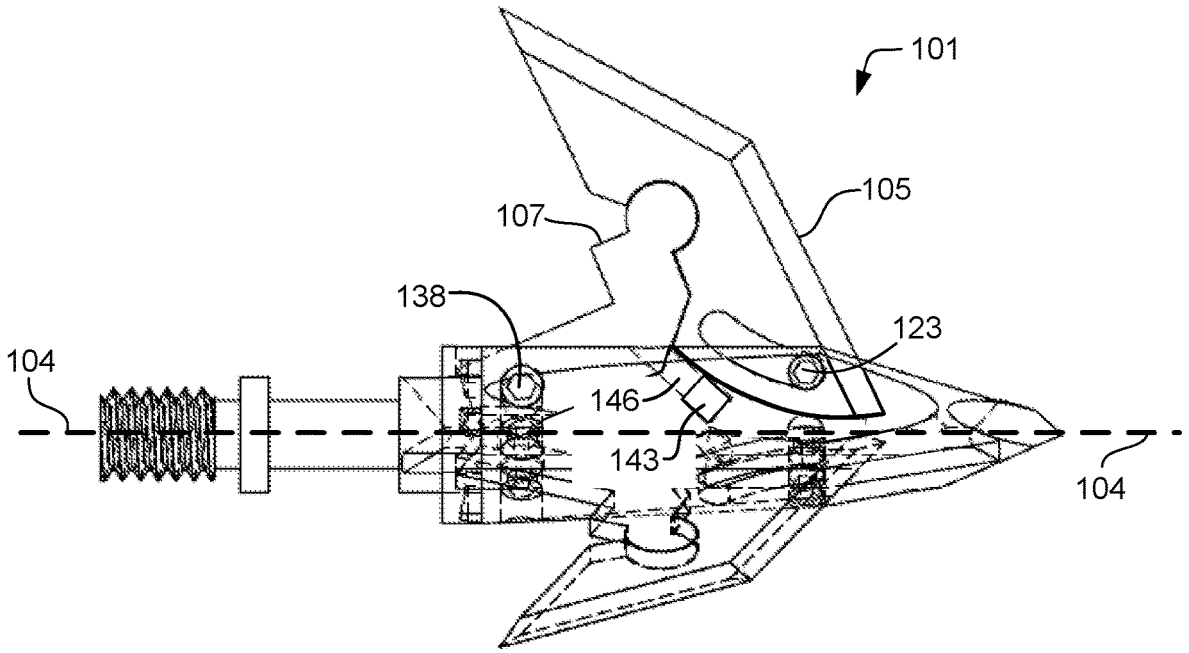
FIG. 10 is an alternate side view of the broadhead assembly of FIG. 9, showing various internal components.

Referring now also to FIG. 10 in the drawings an alternate side view of assembly 101 is illustrated with some of the internal lines within body 103 being shown. Assembly 101 further includes a retention member 143 coupled to an interior of main body 103. Retention member 143 is configured to restrict the free-rotation of pivoting blade 105 between the first position and the second position pre-impact. As noted previously, prior to flight and during flight, blade 105 is restricted to the first position for safety reasons and/or flight characteristics. Retention member 143 is configured to fulfill this role by keeping blade 105 in the first position until impact. Upon impact, blade 105 breaks free from retention member 143 and moves to the second position. Although retention member 143 may take different embodiments, one embodiment is where member 143 is a magnet that is configured to induce a magnetic attraction on the trailing arm in the first position.

As seen in FIG. 10, member 143 is shown within a bore in main body 103. Curved edge 119 passes adjacent the bore 146. The curved nature of surface 119 allows the rotation of blade 105 not to interfere with member 143. Additionally, second edge 141 has surfaces that are not parallel. Surface 145 of second edge 141 is configured to flushly abut (i.e. adjacent) retention member 143. The non-parallel surfaces of second edge 141 also help to avoid contact between trailing arm 107 and retention member 143 when blade 105 is in the first position.

An object of including member 143 within body 103 is to secure the blades within a retracted position. As stated previously, the nature of edge or surface 119 may be that of a curve or a linear line. Depending on the configuration of blades 105 and trailing arm 107, the precise location and route of bore 146 and member 143 is not restricted to that depicted herein. Of importance is the use of member 143 to capture a surface of trailing arm 107 so as to temporarily restrict rotation. Bore 146 may be located in and through any interior or exterior surface of body 103. For example, bore 146 may pass through threaded base 110 or any part of body 103 above or below collar 109. In some embodiments, shaft 99 may be used to close or cover a portion of bore 146. Bore 146 is a path used to locate member 143 internally within a portion of body 103.

Figure 11:
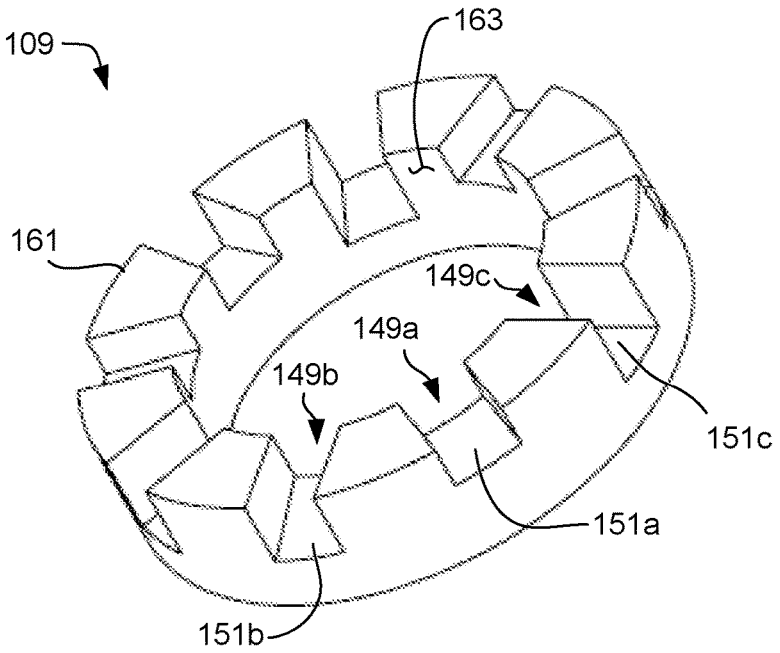
FIG. 11 is a perspective view of a collar used in the broadhead assembly of FIG. 1.
Figure 12:
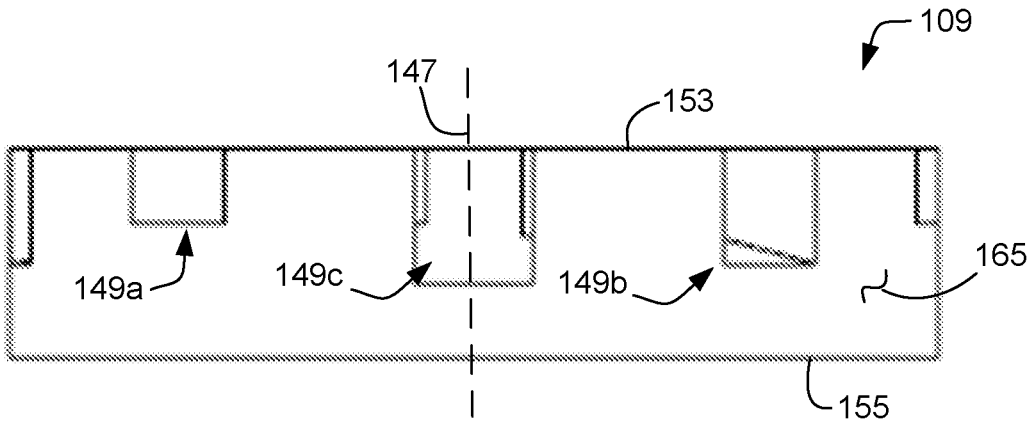
FIG. 12 is a side view of the collar of FIG. 11.
Figure 13:
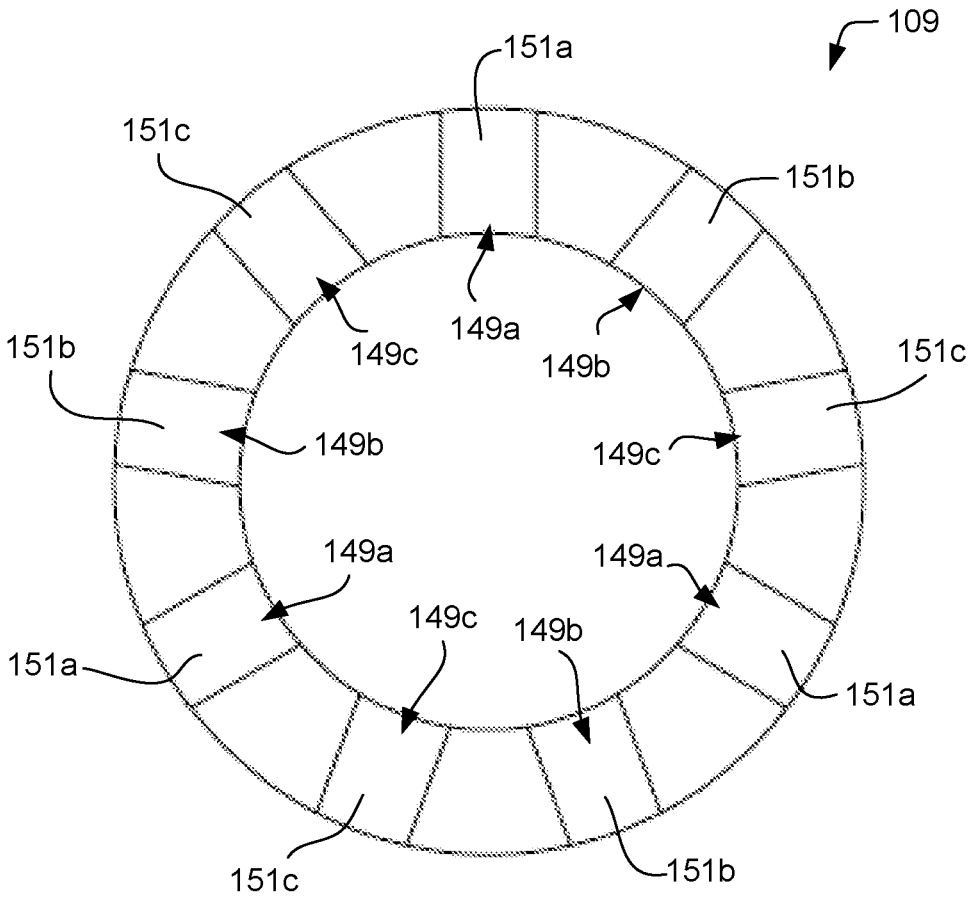
FIG. 13 is a top view of the collar of FIG. 11.

Referring now also to FIGS. 11-13 in the drawings, views of collar 109 are illustrated. Collar 109 has a body 161 with a hollowed center. Body 161 includes an internal surface 163 and an external surface 165, along with top surface 153 and a bottom surface 155. Collar 109 is detachably coupled to a bottom surface of main body 103. Collar 109 has a collar axis 147 concentric with the central axis 104. Collar 109 further includes a plurality of channels 149*a-c* radially dispersed around the collar axis and configured to regulate the movement of the trailing arm. In the depicted embodiments of these figures, each channel passes from internal surface 163 to external surface 165 and extends downward from top surface 153 to a set depth. As noted previously, at least one of the plurality of channels 149*a-c* is aligned with slot 108 and trailing arm 107. Trailing arm 107 is configured to pass within the aligned channel when pivoting from the first position to the second position. It is known however that conceivably the channel may pass through any singular surface (i.e. a hole within) or combination of surfaces 153, 155, 163, and 165 (i.e. a chamfer edge).

Channels 149*a-c* are used to allow a user the ability to adjust the cutting diameter of blades 105. This is done by selectively limiting the rotation of trailing arms 107. As noted previously with FIGS. 8 and 9, not all channels 149*a-c* are aligned with slots 108 simultaneously. It is understood that in the present application, three distinct channels are described, namely 149*a*, 149*b*, and 149*c*. Each channel 149*a-c* corresponds to a particular degree of rotational freedom for trailing arm 107. For example, channel 149*a* prevents rotation of trailing arm resulting in blade 105 being restricted to the first position both pre-impact and post-impact. Channel 149*c* permits rotation of trailing arm 107 to full deployment to the second position. Channel 149*b* is configured to prohibit full rotation of trailing arm 107 such that blade 105 is prevented from reaching the second position but is free to pivot beyond the first position upon impact.

Each channel is able to regulate the size of the cutting diameter by preventing or permitting such degree of rotation for trailing arm 107. Trailing arm 107 includes a surface, such as lower surface 134 (see FIG. 5), that can pass through or contact a face 151*a-c* of a respective channel 149*a-c*. Each channel has a particular depth and slope for face 151*a-c* that is predetermined to permit selected degrees of rotation for trailing arm 107.

As seen in the figures, a total of nine channels are depicted. The number of channels is a factor of the number of blades 105 and the number of predetermined rotation positions permitted by collar 109. In the present application, three blades 105 are used with three distinct channels 149*a-c*. Each set of channels are radially arrayed about axis 147 at a matching angle 112 to that of blades 105. This allows the plurality of blades 105 to all be set within channels that have the same predetermined rotation position. As seen in FIG. 12, channel 149*a* has a shallow depth. The depth of the remaining channels progressively increase going from channel 149*b* to channel 149*c*. The slopes of faces 151*a-c* may be varied between sets of channels 149*a-c*.

It is understood that collar 109 and assembly 101 are not limited to three sets of channels any more than it is limited to the depicted number of blades. Additionally, at least one of the depth and the slope of each set of faces 151*a-c* may be different. It is further understood that collar 109 may include a plurality of channels where each channel is of the same depth and/or slope. Furthermore, the function of channel 149*a* can be conceivably performed by having a surface of trailing arm 107 (i.e. lower surface 134) contact any internal or external surface of collar 109, such as surfaces 153, 155, 163, and 165, wherein possibly no actual channel is needed to facilitate the function of channel 149*a* as depicted.

In operation, a user is able to change the relative alignment of channels 149*a-c* with slots 108. As noted previously, collar 109 is secured between shaft 99 and the base of main body 103. A user can install collar 109 by locating it such that top surface 153 is adjacent main body 103. The user selects which of the channel sets 149*a-c* to use and aligns those channels with slots 108. The collar is then secured in place by tightening shaft 99 against bottom surface 155. Between shots, a user may adjust the orientation of collar 109 to align a different set of channels with slots 108. This is done by loosening shaft 99 wherein collar 109 is free to rotate and then retightening shaft 99 against bottom surface 155 when finished. An advantage of collar 109 being detachable from main body 103 is that it is usable with various different types of broadheads. A user can carry one or more collars and only need one broadhead as the collar can regulate the cutting diameter. This avoids the need to store or carry multiple broadheads.

The current application has many advantages over the prior art including at least the following: (1) nonlayered blade configuration; (2) reduced drag at the connection point between the blade and the trailing arm; (3) use of a socket and disk having equal thickness; (4) a socket with over 180 degrees of surface area; (5) the ability to adjust the cutting diameter of the blades; and (6) a detachable collar.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A broadhead assembly, comprising:

a main body having a central axis and a mating surface for coupling to an arrow shaft, the main body having a tip;

a pivoting blade pivotally coupled to the main body proximate to the tip, the pivoting blade configured to pivot within the main body so as to operate between a first position and a second position, the pivoting blade including a socket along a trailing edge; and a trailing arm extending between the main body and the pivoting blade, the trailing arm resting within the socket, the trailing arm in planar alignment with the pivoting blade.

2. The assembly of claim 1, wherein the trailing arm has a first edge configured to contact the trailing edge of the pivoting blade when in the first position.

3. The assembly of claim 1, wherein the trailing arm has a second edge configured to contact the trailing edge of the pivoting blade when in the second position.

4. The assembly of claim 1, wherein the socket has a surface area that extends greater than 180 degrees and less than 360 degrees radially.

5. The assembly of claim 1, wherein the pivoting blade includes a slot for engagement with a pin in the main body, movement between the first position and the second position moves the pin within the slot.

6. The assembly of claim 1, wherein the trailing arm has a disk configured to rotate within the socket between the first position and the second position of the pivoting blade.

7. The assembly of claim 6, wherein the disk includes an upper surface and a lower surface that define a thickness less than or equal to the thickness of the blade about the socket.

8. The assembly of claim 1, wherein the pivoting blade has a plane of rotation parallel to the central axis, the pivoting blade is configured to sweep between the first position and the second position without contacting or passing through the central axis.

9. The assembly of claim 8, further comprising:

a retention member coupled to an interior of the main body, the retention member configured to restrict free rotation of the pivoting blade between the first position and the second position pre-impact, the retention member configured to induce a magnetic attraction on the trailing arm in the first position.

10. The assembly of claim 1, further comprising:

a collar coupled to a bottom surface of the main body, the collar having a collar axis concentric with the central axis, the collar having a plurality of channels radially dispersed from the collar axis and configured to regulate the movement of the trailing arm;

wherein at least one of the plurality of channels being aligned with the trailing arm, the trailing arm configured to pass within the at least one of the plurality of channels; and wherein the plurality of channels includes a first channel and a second channel.

11. The assembly of claim 10, wherein the plurality of channels prevents rotation of the trailing arm and the pivoting blade so as to maintain the pivoting blade in the first position post-impact.

12. The assembly of claim 10, wherein the plurality of channels permits a full rotation of the trailing arm such that the pivoting blade rotates into the second position.

13. The assembly of claim 10, wherein the plurality of channels prevents a full rotation of the trailing arm such that the pivoting blade is restricted from reaching the second position.

14. The assembly of claim 10, wherein the plurality of channels each have a face configured to selectively contact a lower surface of the trailing arm so as to selectively restrict rotation of the trailing arm.

15. The assembly of claim 10, wherein the first channel and the second channel having a face with a different depth and slope, the depth and slope of the face dictates the level of rotation of the pivoting blade between the first position and the second position, the trailing arm having a lower surface configured to contact the face of at least one of the first channel and the second channel.

16. The assembly of claim 10, wherein the alignment of the plurality of channels can change relative to the trailing arm, such that the alignment of the trailing arm can switch between the first channel and the second channel.

17. A collar for use at the base of a broadhead having pivoting blades, comprising:

a body having a hollowed center, the body including an internal surface and an external surface, the body having a top surface and a bottom surface;

a first channel passing from the internal surface through the exterior surface, the first channel extending into the body from the top surface, the first channel defining a depth and a slope; and a second channel passing from the internal surface through the exterior surface, the first channel extending into the body from the top surface, the second channel defining a depth and a slope, the depth and slope of the first channel being different from that of the depth and slope of the second channel;

wherein first channel and the second channel are configured to regulate the rotation of the pivoting blades, the first channel permitting less rotation of the pivoting blades than the second channel.

18. The collar of claim 17, wherein the body can be rotated about the base of the broadhead to interchange which of the first channel and the second channel communicate with the pivoting blades.

19. A method of regulating the rotation of pivoting blades in a broadhead, comprising:

obtaining the collar of claim 17;

locating the collar at the base of the broadhead with the top surface adjacent to the broadhead;

aligning at least one of the first channel and the second channel with at least one of the pivoting blades; and securing the collar by compressing the collar between the base of the broadhead and a shaft.

20. The method of claim 19, further comprising:

adjusting the permitted rotation of the pivoting blades by switching alignment of the at least one of the pivoting blades between the first channel and the second channel.

* * * * *